US006308527B1

(12) United States Patent
Kuroyanagi et al.

(10) Patent No.: US 6,308,527 B1
(45) Date of Patent: Oct. 30, 2001

(54) REFRIGERANT EVAPORATOR WITH CONDENSED WATER DRAIN STRUCTURE

(75) Inventors: Isao Kuroyanagi, Anjo; Masamichi Makihara, Gamagori; Toshio Ohara, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/458,164

(22) Filed: Dec. 9, 1999

(30) Foreign Application Priority Data

Dec. 10, 1998 (JP) ..... 10-351513

(51) Int. Cl.[7] ..... F25D 21/14
(52) U.S. Cl. ..... 62/288; 62/515
(58) Field of Search ..... 62/515, 285, 288

(56) References Cited

U.S. PATENT DOCUMENTS 4,487,038 * 12/1984 Iijima ..... 62/515
4,621,685 11/1986 Nozawa .
5,620,046 * 4/1997 Waldhelm et al. ..... 165/153
5,669,439 * 9/1997 Hasegawa et al. ..... 165/153

FOREIGN PATENT DOCUMENTS 0 325 261 A1 * 7/1989 (EP) .
0 325 452 A1 * 7/1989 (EP) .
58-214783 * 9/1982 (JP) .
58-214793 * 9/1982 (JP) .
58-217195 * 10/1982 (JP) .
U-62-34675 2/1987 (JP) .
U-63-67784 5/1988 (JP) .
A-9-170850 6/1997 (JP) .

* cited by examiner

*Primary Examiner*—Henry Bennett
*Assistant Examiner*—Melvin Jones
(74) *Attorney, Agent, or Firm*—Harness, Dickey & Pierce, PLC

(57) ABSTRACT

An evaporator includes a flat tube extending in a vertical direction and having a drain groove for guiding condensed water downward, at a middle portion thereof in an air flow direction. A corrugated fin joined to the tube is divided by a gap portion into an air upstream side first fin and an air downstream side second fin. The gap portion faces the drain groove of the tube. Accordingly, condensed water produced at the air upstream side first fin can be smoothly discharged from the evaporator through the drain groove.

16 Claims, 11 Drawing Sheets

REFRIGERANT EVAPORATOR WITH CONDENSED WATER DRAIN STRUCTURE

CROSS REFERENCE TO RELATED APPLICATION

This application is based upon and claims the benefit of Japanese Patent Application No. 10-351513, filed on Dec. 10, 1998, the contents of which are incorporated herein by reference.

BACKGROUND OF THE INVENTION

1. Field of the Invention

This invention relates to a refrigerant evaporator with a drain structure, particularly suitable for an automotive air conditioner.

2. Description of the Related Art

As shown in FIG. 11, a refrigerant evaporator has plural tubes 2 and corrugated fins 5 respectively disposed between two adjacent tubes 2 and joined thereto. Each of the tubes 2 is composed of two aluminum thin plates 4, which are joined to each other to form a passage therebetween. Each of the corrugated fins 5 is formed from a corrugated aluminum thin plate, and has louvers, which are cut and bent-up from the plate with a specific angle. The louvers improves a thermal conductive efficiency of the fin 5. Meandering inner fins 42, 43 are disposed in and joined to the tubes 2 to improve a thermal conductive efficiency at a refrigerant side.

In the refrigerant evaporator, a central drain groove 10 and a downstream side drain groove 11 are provided at the central portion and a downstream end portion of the tube 2 in an air flow direction A to improve a condensed water draining performance. JP-Y2-4-22225 proposes a similar structure of the evaporator. However, this drain structure is insufficient to drain condensed water from the evaporator. Especially, referring to FIG. 12, condensed water produced at the air upstream side fin and flowing on inner surface angular portions 5*c* of bent portions 5*b* of the fin 5 is difficult to be drained and may clog root portions of the louvers 5*a*.

FIGS. 14A and 14B show an experimental result revealing the problem described above. Experimental conditions were 2.0 m/s in flow rate V of air flowing into a core part 3 of the evaporator, 30° C. in temperature of the air, 60% in relative humidity RH of the air, and 4 mm in fin pitch fp of the corrugated fin 5. FIG. 14A shows air flow paths at a dry state where no condensed water is produced on the surface of the corrugated fin 5, and at a wet state where condensed water is produced on the corrugated fin 5 to clog the louvers 5*a*. At the dry state, since the louvers 5*a* are not clogged with condensed water, air can pass through the louvers 5*a* to the downstream side end. As opposed to this, at the wet state, air cannot pass through the louvers 5*a* provided between a middle portion to the downstream side end of the fin, because condensed water clogs the louvers 5*a*. As a result, as shown in FIG. 14B, an air side heat conductivity at the wet state is decreased by approximately 15% as compared to that at the dry state.

On the other hand, recently, a size reduction is required to an automotive air conditioner so that a space for installing the air conditioner in a vehicle compartment is reduced. Therefore, the refrigerant evaporator is also required to be size-reduced especially in the air flow direction A. To comply with this requirement, the refrigerant evaporator must be improved to have higher capacity. Generally, increasing an air side thermal conductivity largely improves the evaporator capacity, and the air side thermal conductivity is increased by decreasing the fin pitch. Decreased fin pitch increases a thermal conductive area. When the fin pitch is decreased, however, water holding capacity of the fin is increased to facilitate the clogging of the louvers by condensed water, resulting in deterioration of fin thermal conductivity.

SUMMARY OF THE INVENTION

The present invention has been made in view of the above problem. An object of the present invention is to improve drain performance of condensed water and to improve fin thermal conductivity in an evaporator.

According to the present invention, a refrigerant evaporator has a tube defining a passage in which refrigerant flows and having an outer wall with a drain groove for guiding condensed water downward, and a corrugated fin having plural louvers for increasing a contact area with air flowing in an air flow direction and joined to the outer wall of the tube. The corrugated fin has a first fin and a second fin, which are divided by a gap portion facing the drain groove.

The gap portion intercepts flow of condensed water from the first fin, which is disposed at an air upstream side of the second fin in the air flow direction, so that condensed water can be smoothly discharged through the drain groove. Because condensed water produced at the first fin does not flow into the second fin, louver opening portions of the second fin are not clogged with condensed water from the first fin, thereby preventing deterioration of fin thermal conductivity.

The gap portion is required only to intercept the flow of condensed water. That is, the gap portion is not required to form a passage for condensed water. Therefore, a width of the gap portion can be made much smaller than that of the drain groove not to largely decrease a fin thermal conductive area. The first fin and the second fin may be connected with each other via a connecting member crossing the gap portion.

BRIEF DESCRIPTION OF THE DRAWINGS

Other objects and features of the present invention will become more readily apparent from a better understanding of the preferred embodiments described below with reference to the following drawings, in which.

DETAILED DESCRIPTION OF THE PREFERRED EMBODIMENTS (First Embodiment)

Figure 1:
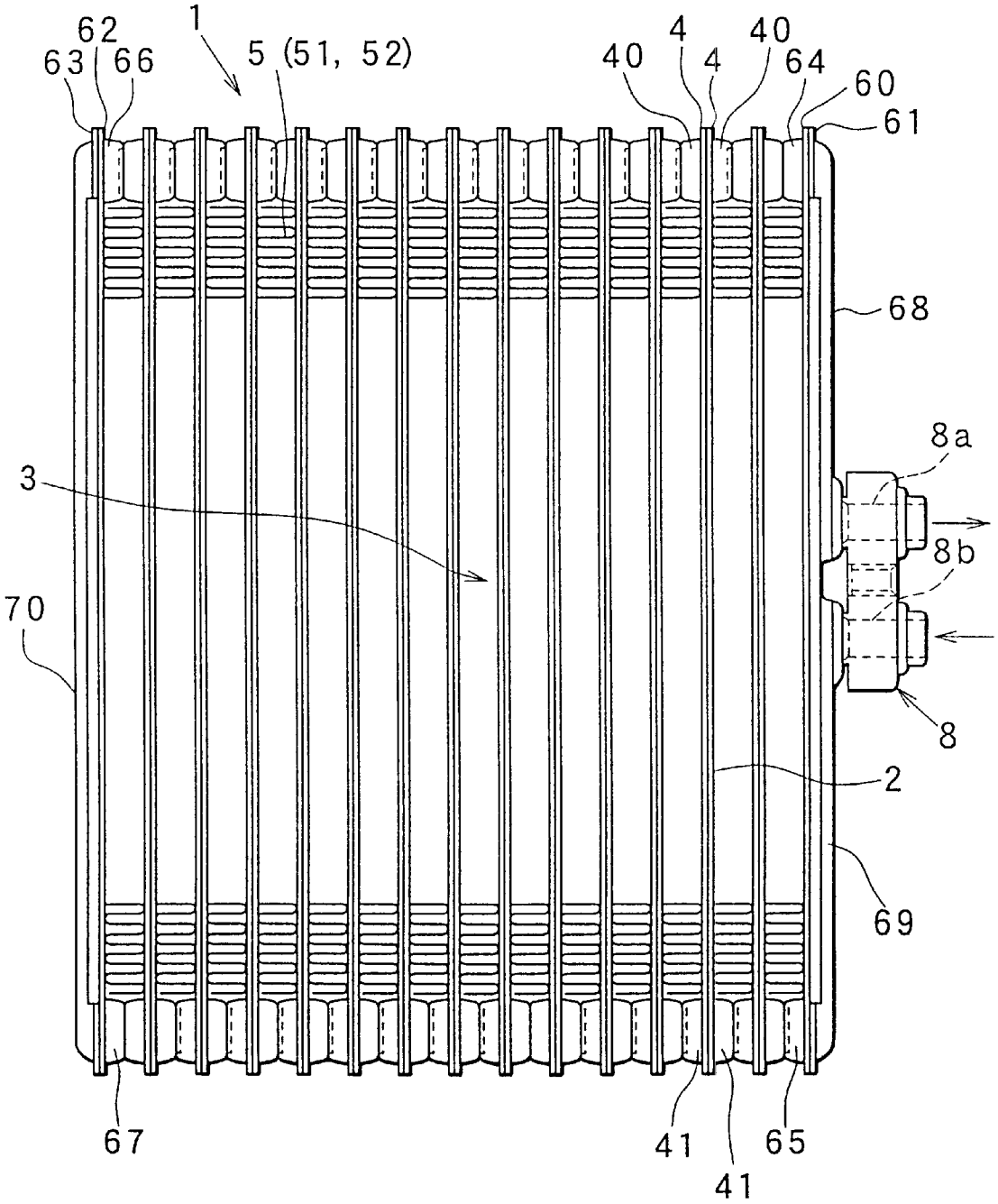
FIG. 1 is a side view showing a refrigerant evaporator in a first preferred embodiment.
Figure 11:
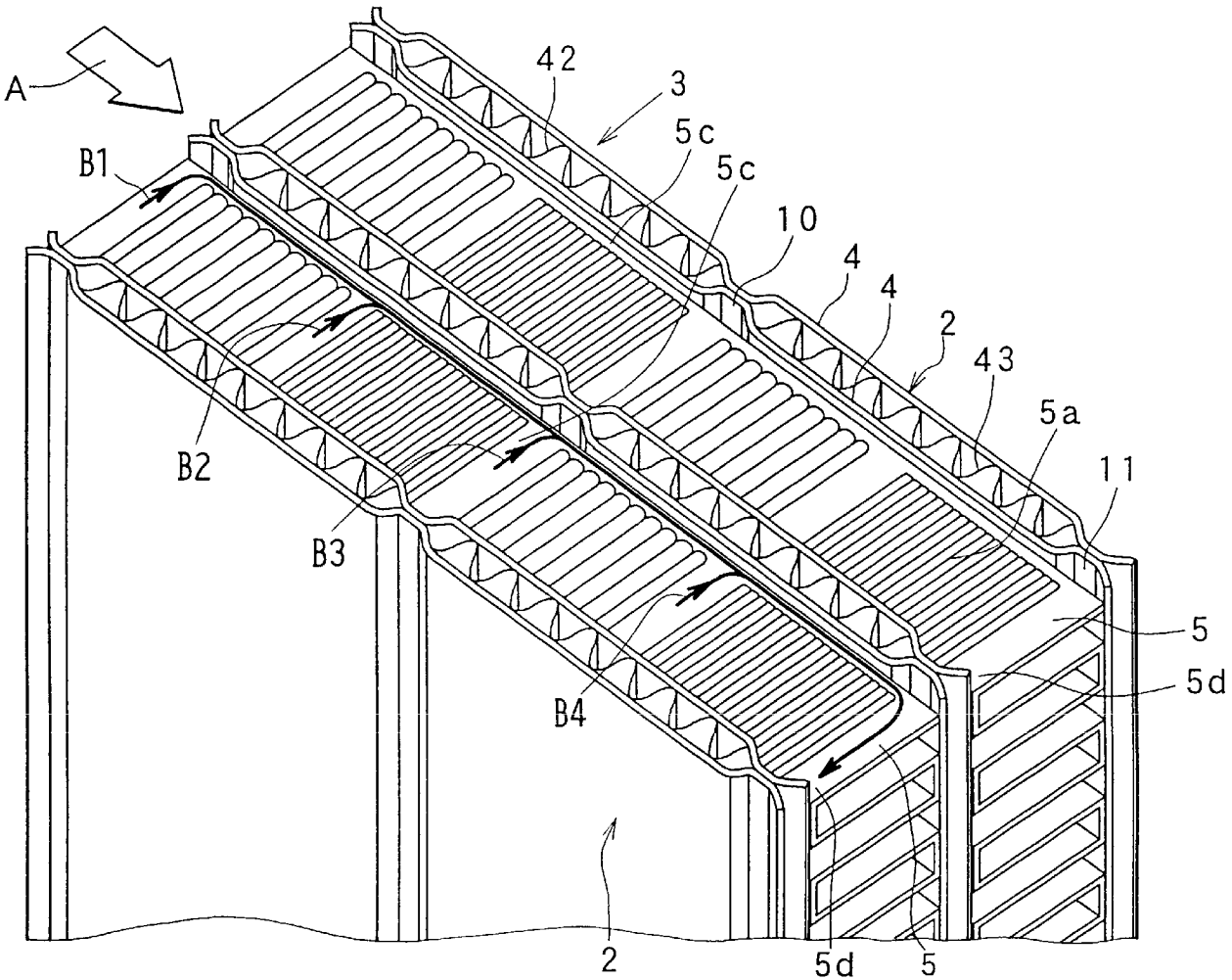
FIG. 11 PRIOR ART
FIG. 11 is a perspective cross-sectional view showing a main portion of an evaporator in a prior art.

An evaporator 1 shown in FIG. 1 in a first preferred embodiment is applied to an automotive air conditioner. Gas-liquid two-phase refrigerant with low temperature and low pressure flows into the evaporator 1 after decompressed by a temperature actuated type expansion valve not shown. The evaporator 1 is installed in an air conditioning unit case of the air conditioner with a vertical direction corresponding to that in FIG. 1. In FIG. 1, the same parts as those of the evaporator shown in FIG. 11 are indicated by the same reference numeral.

Figure 2:
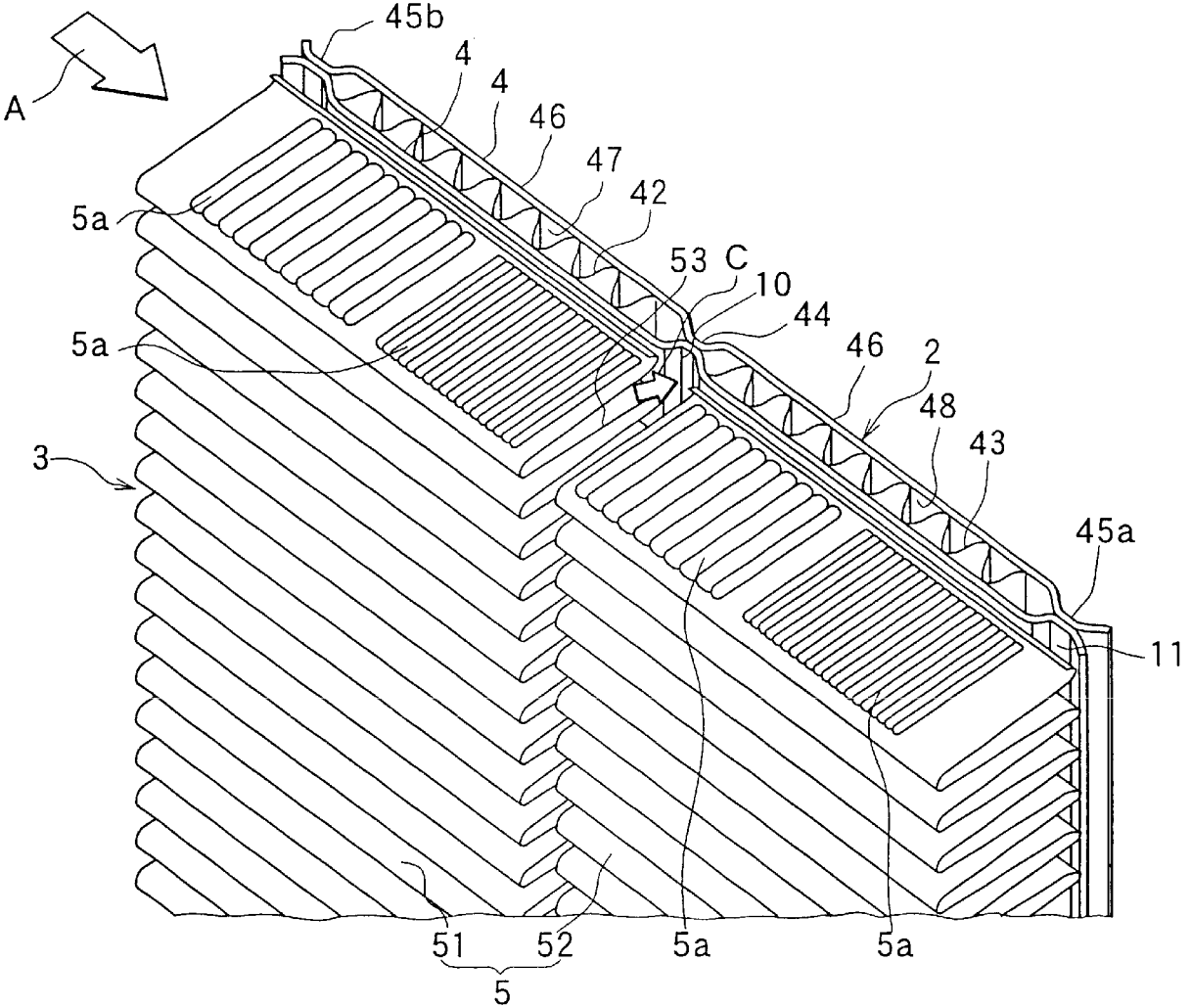
FIG. 2 is a perspective cross-sectional view partially showing the evaporator in the first embodiment.

The evaporator 1 has plural tubes 2 arranged in parallel at a heat exchanging core part 3 thereof. Refrigerant flowing in the tubes 2 evaporate by exchanging (absorbing) heat with air flowing outside the tubes 2. As shown in FIG. 2, the tubes 2 form passages having a flat shape in cross-section. A longitudinal direction of the tubes 2 corresponds to the vertical direction of the evaporator 1, and refrigerant flows in the passage in the vertical direction. As shown in FIG. 2, air flow direction A into the heat exchanging core part 3 is approximately horizontal (perpendicular to a paper space in FIG. 1). Air flows in the direction A, which is approximately perpendicular to the longitudinal direction of the tubers 2. The flat shape in cross-section of the tubes 2 is approximately parallel to air flow direction A.

The tubes 2 are composed of laminated metallic thin plates (core plates) 4, a structure of which is well-known as disclosed in JP-A-9-170850. Each of the metallic plates 4 is a both-surface clad member (thickness: approximately 0.6 mm) composed of an aluminum core member, both surfaces of which are cladded with brazing filler metal, and formed into a specific shape. Two plates 4 are brazed to each other to form a tube 2 as a pair, and plural pairs of the plates 4 are laminated with one another, thereby forming the plural tubes 2 arranged in parallel.

As shown in FIG. 1, tank portions 40, 41 having cup-like shapes are disposed at both ends of the tubes 2 in the longitudinal direction thereof, and protrude outward more than the thickness of the tubes 2 in a lamination direction of the tubes 2. The tank portions 40, 41 are integrally formed at the end portions of the metallic plate 4. Communication holes (not shown) are provided in the tank portions 40, 41 respectively connecting the refrigerant passages in the tubes 2 at both ends (upper and lower ends in FIG. 1) of the tubes 2.

Next, the core part 3 is specifically explained below. FIG. 2 shows only a pair including a tube 2 composed of two metallic thin plates 4 and a corrugated fin 5 at the core part 3 in an enlarged view. Each of the metallic thin plates 4 has a rib-like central partitioning portion 44 extending in the tube longitudinal direction (vertical direction in FIG. 1) generally at a central portion in the air flow direction A thereof. The central partitioning portion 44 has a concave wall for forming a central drain groove 10 for guiding condensed water downward generally at the central portion of the tube 2 in the air flow direction A.

The metallic thin plate 4 further has outer periphery joining portions 45*a*, 45*b* at downstream end and upstream end in the air flow direction A. The outer periphery joining portions 45*a*, 45*b* are formed with a rib-like shape not only at the downstream and upstream ends but at an entire outer circumference of the plate 4. The outer periphery joining portion 45*b* has a concave wall for forming a downstream end drain groove 11 for guiding condensed water downward at the downstream end of the tube 2 in the air flow direction A.

The metallic thin plate 4 has concave portions 46 between the central partitioning portion 44 and the joining portions 45*a*, 45*b*. The concave portions 46 are recessed outward with a specific dimension from the portions 44, 45*a*, 45*b*. Accordingly, two refrigerant passages 47, 48 are provided in parallel with each other at both right and left sides (air upstream side and air downstream side) of the central partitioning portion 44 by joining the two metallic thin plates 4 at the outer periphery joining portions 45*a*, 45*b* to each other. Meandering inner fins 42, 43 are disposed in the refrigerant passages 47, 48, respectively, and joined to the plates 4.

The corrugated fin 5 is disposed between and joined to the outer surfaces of the adjacently arranged two tubes 2 with a corrugated (meandering) direction approximately parallel to the vertical direction. The corrugated fin 5 is formed from an aluminum bare member, which is not cladded with brazing filler metal and is formed by bending to meander, so that the corrugated fin 5 increases a thermal conductive area at an air side.

Figure 3:
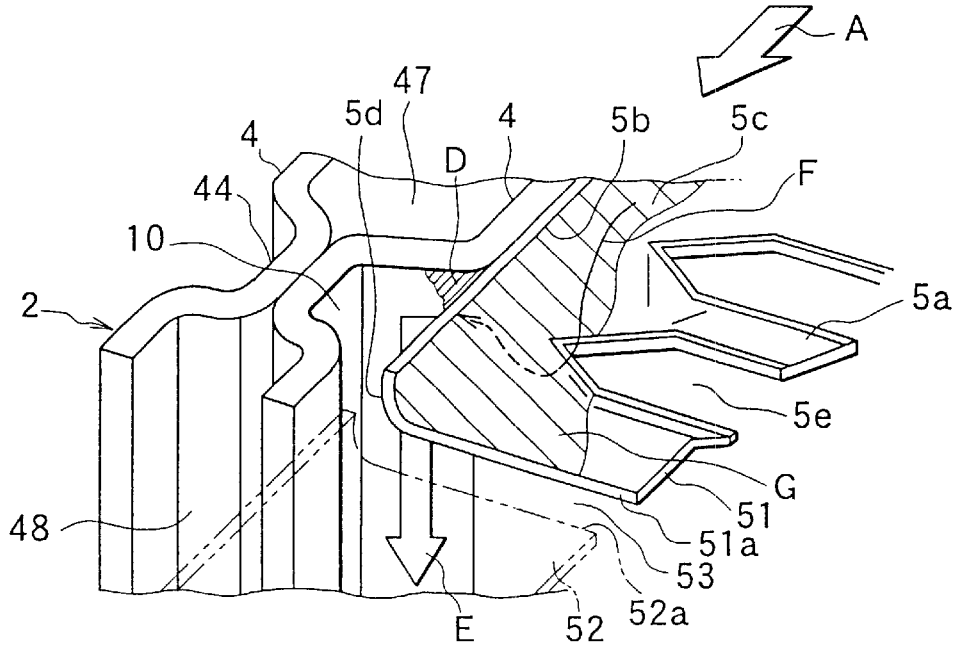
FIG. 3 is a perspective enlarged view showing a main portion of FIG. 2.
Figure 14B:
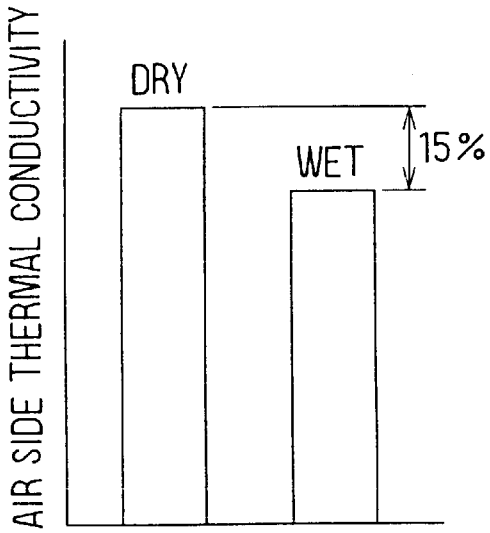
FIG. 14B is a graph showing air side thermal conductivities at the dry state and the wet state.
Figure 14A:
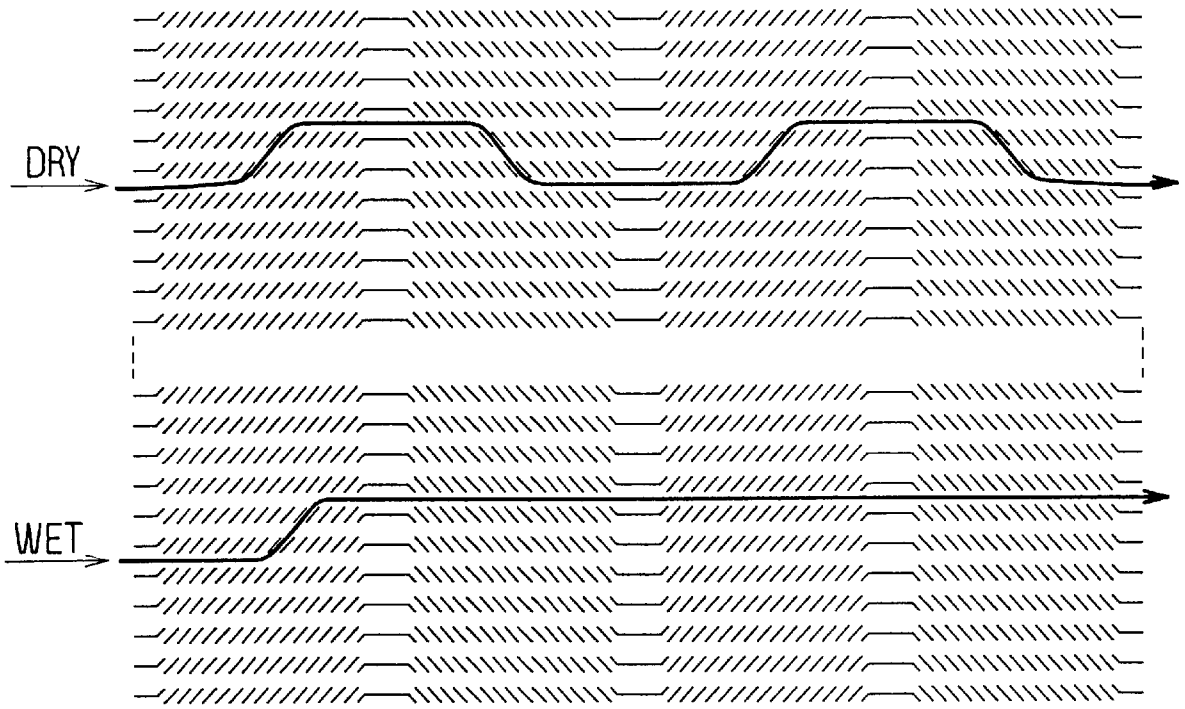
FIG. 14A is an explanatory view showing an experimentally confirmed air flow paths at a dry state and a wet state within a corrugated fin.

As shown in FIGS. 2 and 3, louvers 5*a* are formed on the corrugated fin 5 by cutting and bending up with a specific angle to improved a fin thermal conductive efficiency. The louvers 5*a* are formed with louver opening portions 5*e*, and air passes through the louver opening portions 5*e*. As shown in FIG. 14, in each of the corrugated fins 51, 52, the direction in which the louvers 5*a* extend at the upstream side is reversed to that in which the louvers 5*a* extend at the downstream side, so that the air flow direction changes between the upstream side and the downstream side.

Figure 4:
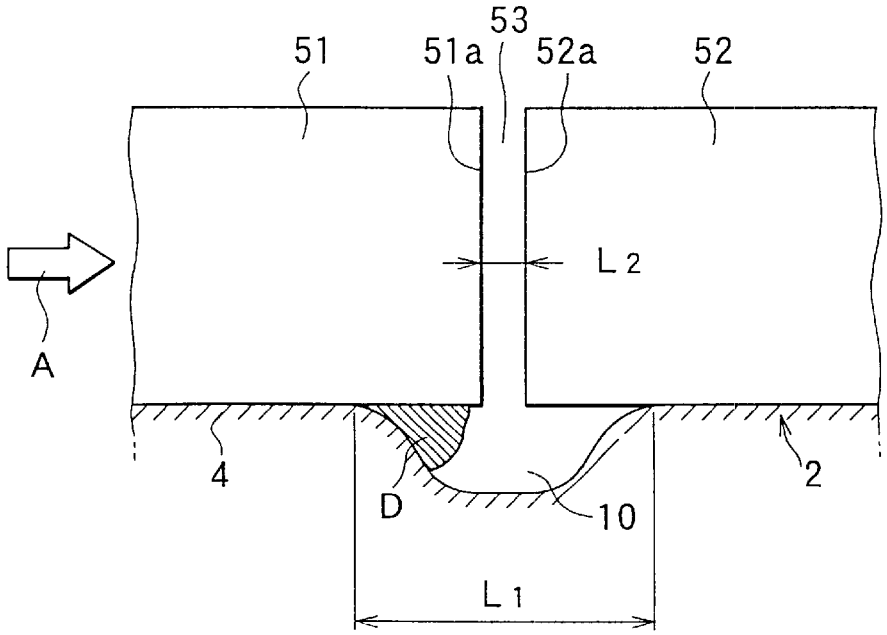
FIG. 4 is a plan view schematically partially showing fins and a central drain groove in the first embodiment.
Figure 5:
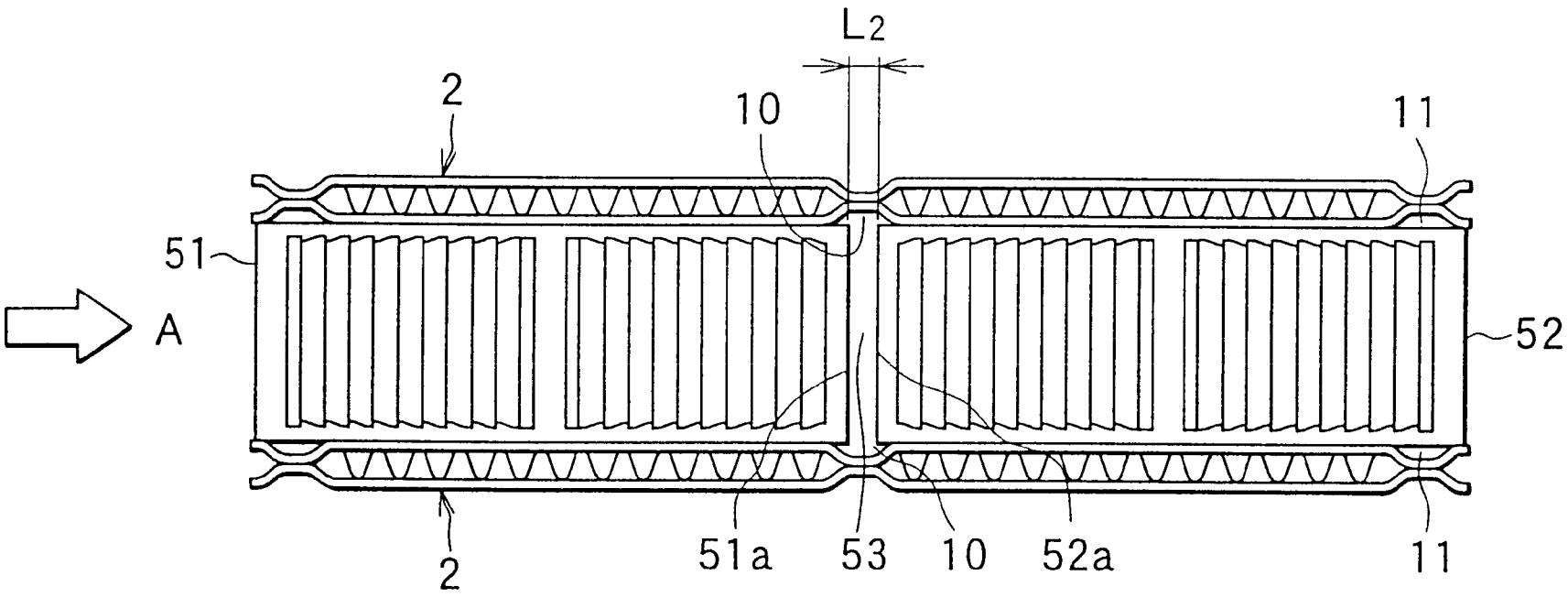
FIG. 5 is a cross-sectional view showing a main portion of the evaporator in the first embodiment.

Further, in the present embodiment, the corrugated fin 5 is divided in the air flow direction A into an upstream side first fin 51 and a downstream side second fin 52 by a gap portion 53, which is provided generally at the central portion of the corrugated fin 5 where air flow direction is changed. As shown in FIGS. 4 and 5, the gap portion 53 provided at the central portion in the air flow direction A faces approximately the center of the central drain groove 10 provided by the central partitioning portion 44.

As shown in FIG. 3, the gap portions 53 intercepts condensed water flow progressing from the first fin 51 to the second fin 52, and guides condensed water into the central drain groove 10 through the louver opening portions 5*e* provided at the most downstream side of the first fin 51. Interval $L_2$ of the gap portion 53 is, as shown in FIG. 4, sufficiently smaller than width $L_1$ of the central drain groove 10. For example, the width $L_1$ is approximately 5 mm, and the interval $L_2$ is in a range of approximately 1 to 2 mm. Accordingly, since the gap portion 53 is provided at the central portion where the central drain groove 10 is provided, both the upstream side first fin 51 and the downstream side second fin 52 partially face the central drain groove 10 within the width $L_1$.

Referring back to FIG. 1, the evaporator 1 further has an end plate 60 disposed at an end portion (right end portion) in the lamination direction of the metallic thin plates 4, a side plate 61 joined to the end plate 60, another end plate 62 disposed at the other end portion (left end portion) in the lamination direction, and another side plate 63 joined to the end plate 62. Each of the plates 60, 61, 62, 63 is formed from a both-surface clad member similarly to the metallic thin plates 4 as described above.

The end plates 60, 62 have tank portions 64 to 67 similar to the tank portions 40, 41 of the metallic thin plates 4, and are joined to the corrugated fins 5 (51, 52), which are disposed at the most outer sides in the lamination direction. The right side plate 61 has first and second protruding portions 68, 69 defining therein first and second side refrigerant passages divided at upper and lower sides, respectively. The left side plate 63 has a protruding portion 70 defining therein a side refrigerant passage.

A pipe joint 8 is disposed between a lower end of the first protruding portion 68 and an upper end of the second protruding portion 69, and joined thereto. The pipe joint 8 is formed into a generally elliptic block body from an aluminum bare member. A refrigerant outlet hole 8*a* and a refrigerant inlet hole 8*b* penetrate the block body in a thickness direction of the block body, for connection with an external refrigerant circuit. The refrigerant outlet hole 8*a* communicates with the upper side refrigerant passage defined by the first protruding portion 68, and the refrigerant inlet hole 8*b* communicates with the lower side refrigerant passage defined by the second protruding portion 69. The refrigerant inlet hole 8*b* is further connected to an outlet side refrigerant pipe of an expansion valve not shown, and the refrigerant outlet hole 8*a* is connected to a suction pipe of a compressor not shown.

Next, a method of manufacturing the evaporator 1 in the present embodiment is explained briefly. First, parts such as the metallic thin plates 4 for forming the tubes 2, and the corrugated fins 5 are provisionally assembled by lamination into a state shown in FIG. 1. After that, the assembled body is carried into a furnace while keeping the assembled state by a jig or the like. The assembled body is then heated up to a melting point (around 600° C.) of the brazing filler metal of the aluminum clad members, thereby integrally brazing the evaporator 1 at respective joining portions.

Next, operation of the above constitution in the present embodiment is explained. Gas-liquid two phase refrigerant with a low pressure, decompressed by the expansion valve of a refrigerating cycle not shown, flows into the refrigerant inlet hole 8*b* of the pipe joint 8, and flows in the refrigerant passages 47, 48 defined within the tubes 2 in the vertical direction. In the passages 47, 48, refrigerant evaporates by exchanging (absorbing) heat, through the metallic thin plates 4 and the corrugated fins 51, 52, with blowout air passing through the core part 3 in the direction A. Air is cooled by the heat exchange and dehumidified.

A difference between air temperature and refrigerant evaporation temperature is maximum at the air flow upstream side (air inlet side of the air upstream side first fin 51) of the core part 3. Therefore, air is suddenly cooled at the air upstream side of the core part 3, to produce a large amount of condensed water. The produced amount of condensed water decreases as it progresses to the air downstream side.

Figure 13:
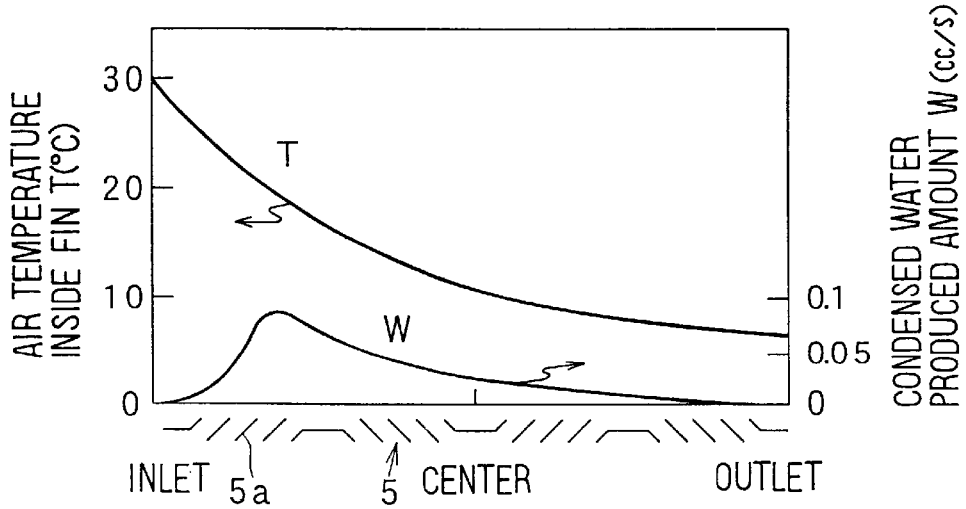
FIG. 13 is a graph showing distribution of a condensed water produced amount and air temperature in the evaporator.

Here, a condensed water produced state was experimentally examined using the refrigerant evaporator shown in FIG. 11 in which the corrugated fin 5 has no gap portion 53. The result is shown in FIG. 13. Experimental conditions of FIG. 13 were 2.7 m/s in flow speed V of air into the core part 3, 30° C. in temperature of the air, 60% in relative humidity RH of the air, and 4 mm in fin pitch fp of the corrugated fin 5. In FIG. 13, a horizontal axis indicates a position of the corrugated fin 5 where the air flows, in the air flow direction A. As understood from distribution of a condensed water produced amount W, condensed water is largely produced at the air upstream side of the core part 3. The produced amount W of condensed water gradually decreases as it progresses to the air downstream side.

In the evaporator shown in FIG. 11, the corrugated fin 5 is continuously disposed from the air upstream side to the air downstream side as a simple body. Therefore, referring to FIG. 12, condensed water, which flows on inner surface corner portions 5*c* of bent portions 5*b* of the fin 5, does not flow out into the central drain groove 10 on the way. The condensed water flowing on the inner surface corner portions 5*c* flows to the air downstream side as indicated by arrows B1 to B4 in FIG. 11, and then is discharged downward via the downstream end drain groove 11. Condensed water produced at outer surfaces 5*d* of the bent portions 5*b* is discharged both from the central drain groove 10 and the downstream end drain groove 11.

On the other hand, according to the present embodiment, because the corrugated fin 5 has the gap portion 53 facing the central drain groove 10, condensed water produced on the upstream side first fin 51 is readily discharged from downward through the central drain groove 10. Specifically, condensed water flowing on the inner surface corner portions 5*c* of the bent portions 5*b* of the upstream side first fin 51 is urged by air flow to the downstream side end portion 51*a* of the first fin 51. This condensed water flow on the inner surface corner portions 5*c* is prevented by the gap portion 53 from flowing to the downstream side further. As a result, condensed water gathers around the downstream side end portion 51*a* of the first fin 51 by surface tension thereof to form a liquid film G (see FIG. 3). The liquid film G is continuously formed to the most downstream side louver opening portion 5*e* of the first fin 51 due to the supply of condensed water from the air upstream side.

Condensed water flowing on the outer surfaces 5*d* of the end portions 5*b* of the first fin 51 flows, as indicated by arrow C in FIG. 2, into the central drain groove 10 directly at the gap portion 53. In the central drain groove 10, condensed water passage D is provided around the joining portion between the outer surface of the metallic thin plate 4 and the outer surface 5*d* of the bent portion 5*b* of the first fin 51, and condensed water drops in the passage D downward as indicated by an arrow E in FIG. 3. At that time, an attraction is applied to condensed water contacting the condensed water dropping in the direction E, toward the passage D by the surface tension.

The attraction is also applied to the condensed water liquid film G around the air downstream side end portion 51*a* described above toward the passage D through the louver opening portions 5*e*. Accordingly, the condensed water surrounded by the liquid film G is sucked into the passage D along the back surface of the first fin 51 through the louver opening portions 5*e* as an arrow F. Thus, condensed water flowing on the inner surface corner portions 5*c* of the bent portion 5*b* of the first fin 51 is continuously sucked into the passage D defined in the central drain groove 10 through the most downstream side louver opening portions 5*e,* thereby being discharged downward. Here, it is preferable that the louvers 5*a* are provided in close proximity to the bent portions 5*b*.

When a fin pitch of the corrugated fin is reduced to increase a thermal conductive area at the air side, water holding capacity is increased. A large amount of condensed water gathers and is kept at the air flow downstream side end portion of the inner surface corner portions 5*c*. When an amount of the gathering condensed water exceeds a specific value, the condensed water flies out toward the evaporator downstream side together with air. This phenomenon is called as a water flying-out phenomenon.

When the water flying-out phenomenon occurs in the automotive air conditioner, flied-out condensed water is liable to be attached to a heat exchanger for heating disposed at the downstream side of the evaporator. The condensed water is then evaporated by high-temperature hot water (engine cooling water) circulating in the heat exchanger so that humidity in a compartment is raised. The increased humidity deteriorates comfortablility in the compartment, and may cause a frosted glass. Therefore, the water flying-out phenomenon should be prevented.

According to the present embodiment described above, the large amount of condensed water produced at the upstream side first fin 51 is discharged through the central drain groove 10 without causing the water flying-out phenomenon. Condensed water produced at the air downstream side second fin 52 flows on the inner surface corner portions 5*c* and the outer surfaces 5*d* of the bent portions 5*b* to reach the downstream side end portion of the fin, and then drops downward through the downstream side discharge groove 11.

The interval $L_2$ of the gap portion 53 can be decreased to be approximately 1 to 2 mm, which is much less than the width $L_1$ of the central drain groove 10. This is because the gap portion 53 is required to have the interval $L_2$ only sufficient for intercepting the condensed water flow passage. Accordingly, the decrease in fin thermal conductive area by the gap portion 53 is suppressed at a minimum while securing a drain performance of condensed water from the central drain groove 10.

According to the present embodiment, because condensed water produced at the air upstream side first fin 51 does not flow to the air downstream side second fin 52, the amount of condensed water flowing at the air downstream side is largely decreased. As a result, the clogging of the louvers 5*a* at root portions thereof can be effectively prevented. It was experimentally revealed that the clogging of the louvers 5*a* was prevented even when the fin pitch fp was 2.6 mm. Incidentally, a conventional fin pitch is in a range of 3.0 to 4.0 mm. Thus, the present embodiment can achieve both the increased fin thermal conductive area by the decreased fin pitch fp and the prevention of the condensed water louver clogging, thereby improving a thermal conductive performance of the evaporator. Here, the fin pitch fp represents, as shown in FIG. 6B, an interval between adjacent two bent portions 5*b*.

(Second Embodiment)

Figure 6A:
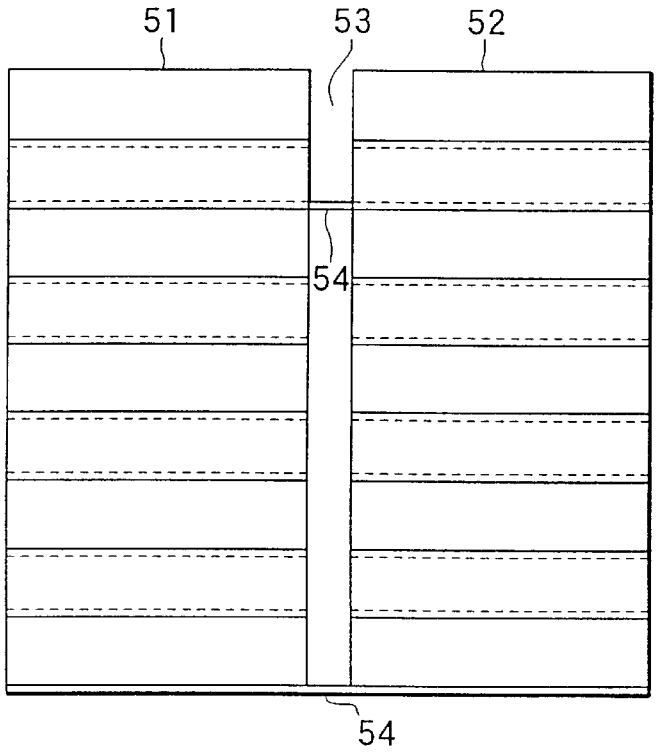
FIGS. 6A to 6C are explanatory views showing a corrugated fin in a second preferred embodiment.
Figure 6B:
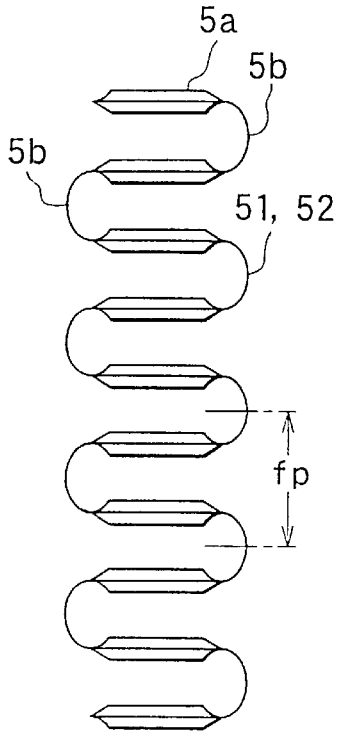
Figure 6C:
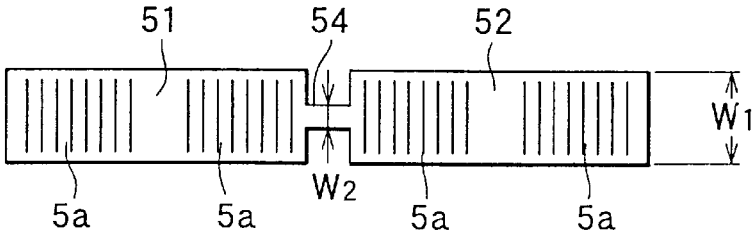

FIGS. 6A to 6C show a second preferred embodiment according to the present invention. In the first embodiment, the first and second fins 51, 52 are completely separated from each other. In the second embodiment, the first and second fins 51, 52 are partially connected to each other via connecting portions 54. As shown in FIGS. 6A to 6C, one connecting portion 54 is provided at each fin part including a specific number of fin crests to integrally connect the fins 51, 52 to each other. Each connecting portion 54 has width $W_2$ much less than width $W_1$ of the fins 51, 52 to intercept condensed water flow progressing to the air downstream side. For example, the width $W_2$ is approximately 2 mm.

According to the second embodiment, because it is easy to hold the first fin 51 and the second fin 52 connected to each other, assembling workability of the fins 51, 52 and the tubes 2 is improved. The number of the connecting members 54 is not limited, although the fin part including the specific number of fin crests has one connecting member 54 in FIGS. 6A to 6C. The number of the connecting members 54 may be one, or may be equal to that of the number of the fin crests.

(Third Embodiment)

Figure 7:
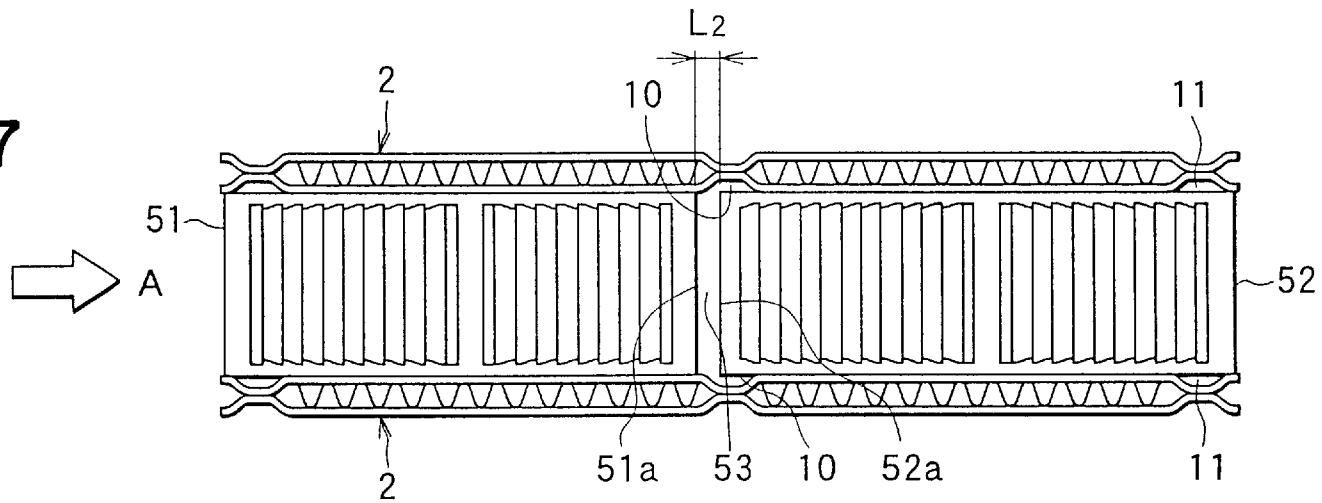
FIG. 7 is a cross-sectional view showing a main portion of an evaporator in a third preferred embodiment.

FIG. 7 shows a third preferred embodiment according to the present invention. In the first embodiment, the gap portion 53 between the first and second fins 51, 52 is provided to face the central portion of the central drain groove 10 such that both the upstream side first fin 51 and the downstream side second fin 52 partially face the central drain groove 10 within the width $L_1$. In the third embodiment, the gap portion 53 is shifted to the air upstream side from the position in the first embodiment such that only the upstream side end portion 52*a* of the downstream side second fin 52 faces the central drain groove 10. The downstream side end portion 51*a* of the upstream side first fin 51 is disposed at the upstream side of the central drain groove 10.

(Fourth Embodiment)

Figure 8:
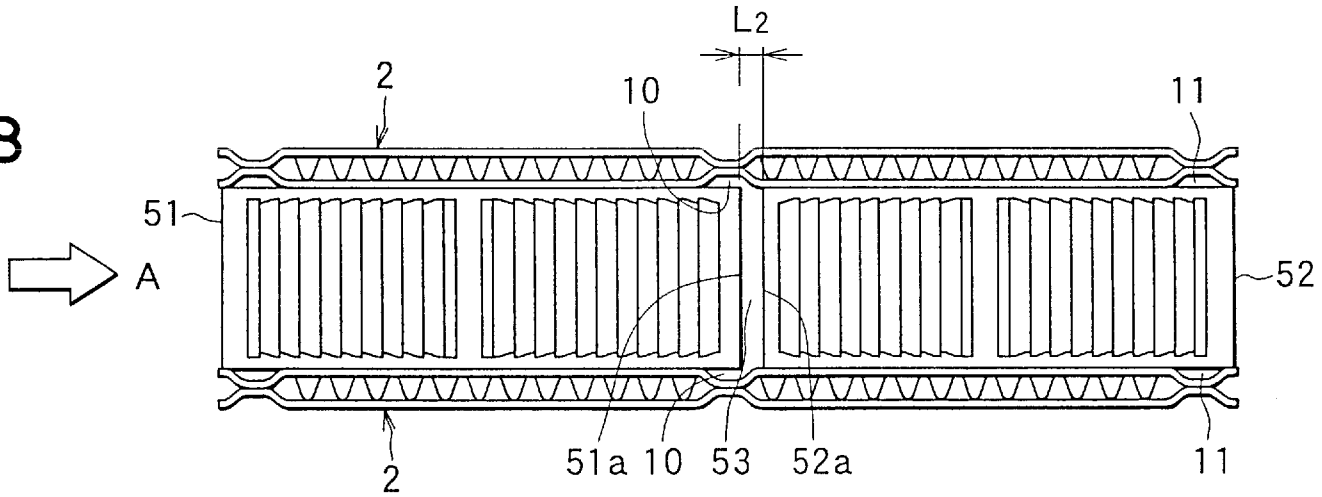
FIG. 8 is a cross-sectional view showing a main portion of an evaporator in a fourth preferred embodiment.

FIG. 8 shows a fourth preferred embodiment according to the present invention. In the fourth embodiment, the gap portion 53 is shifted to the air downstream side from the position in the first embodiment such that only the air downstream side end portion 51*a* of the air upstream side first fin 51 faces the central drain groove 10. The air upstream side end portion 52*a* of the air downstream side second fin 52 is disposed at the downstream side of the central drain groove 10.

Even when the gap portion 53 is shifted from the central portion of the central drain groove 10 as in the third and fourth embodiments, the gap portion 53 intercepts condensed water flow from the air upstream side first fin 51. As a result, condensed water produced at the first fin 51 is smoothly discharged through the central drain groove 10 as in the first embodiment.

(Fifth Embodiment)

Figure 9:
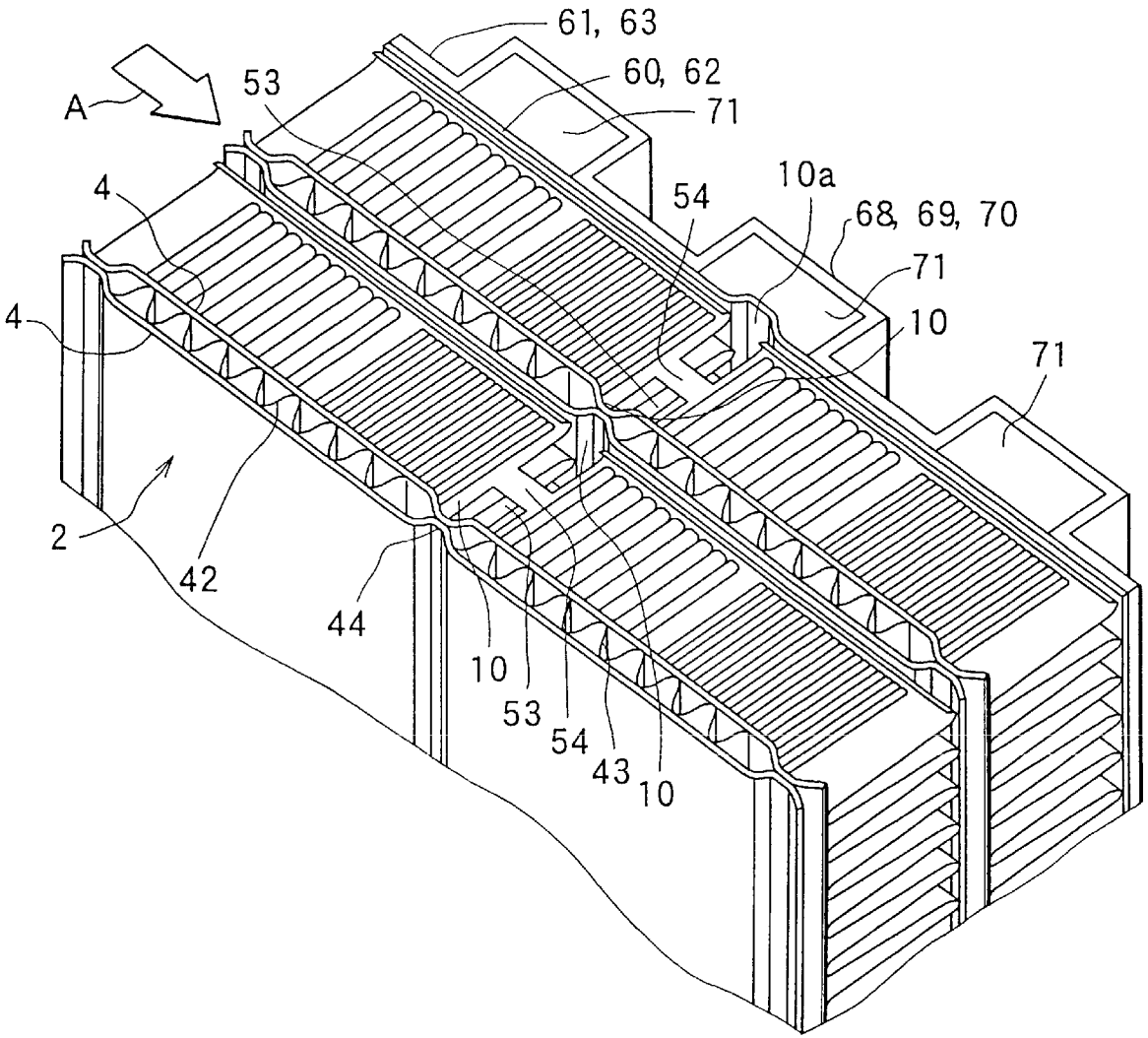
FIG. 9 is a perspective cross-sectional view showing a main portion of an evaporator in a fifth preferred embodiment.

FIG. 9 shows a fifth preferred embodiment according to the present invention. In the fifth embodiment, each of the end plates 60, 62, which is disposed at an outer side of the corrugated fin 5 (51, 52) disposed at the most outer side in the lamination direction in the core part 3, has a central drain groove 10*a* for guiding condensed water downward on the way in the air flow direction A. The gap portion 53 between the first fin 51 and the second fin 52 face the central drain groove 10*a*.

Figure 10:
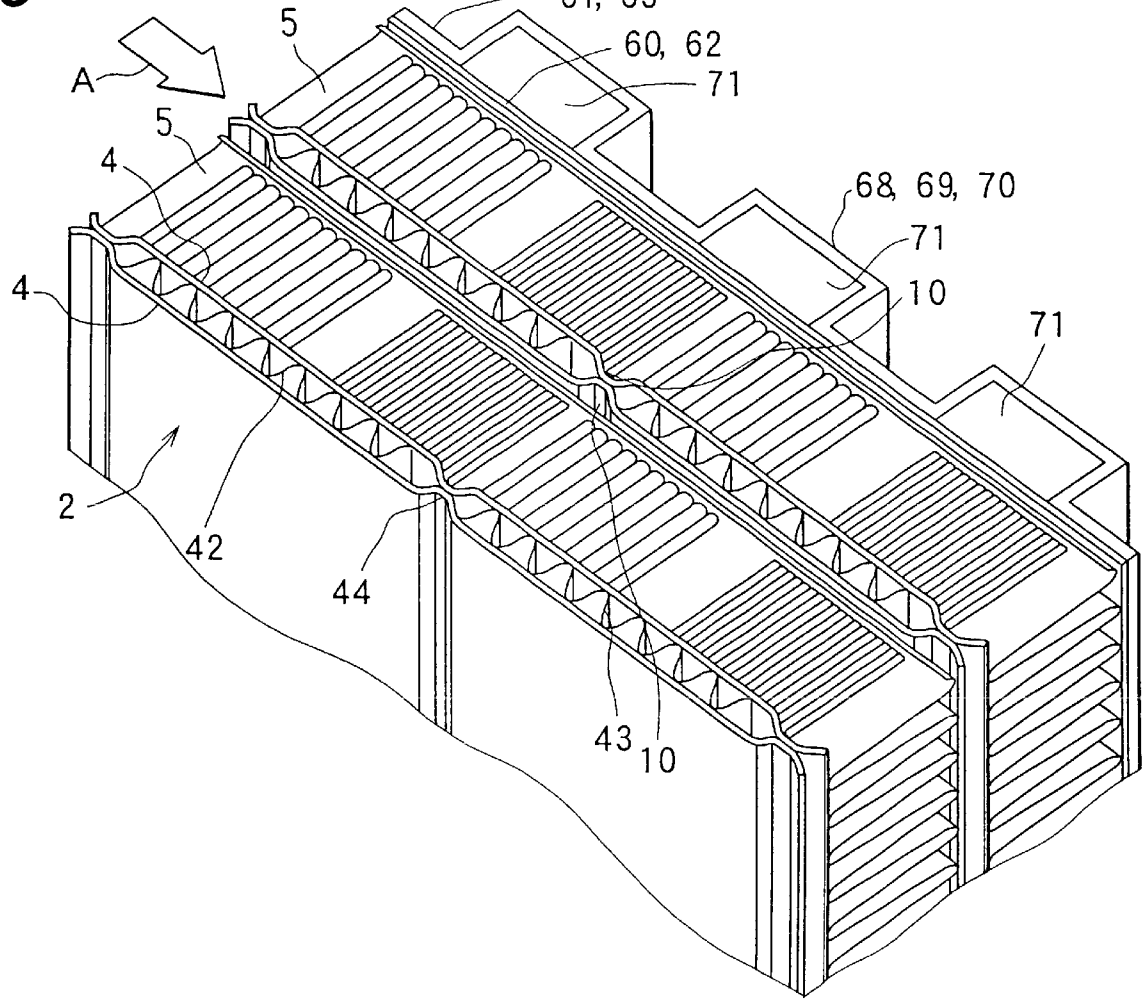
FIG. 10 is a perspective cross-sectional view showing a comparative example of the fifth embodiment.

FIG. 10 shows a comparative example in which no central drain groove 10*a* is provided on the end plates 60, 62. In the comparative example, condensed water produced at the upstream side first fin 51 provided at the most outer side flows along the end plates 60, 62 at the bent portions 5*b* of the fins 5 joined to the end plates 60, 62 toward the downstream side second fin 52.

As opposed to this, according to the fifth embodiment, condensed water produced at the first fin 51 is smoothly discharged through the central drain grooves 10*a* of the end plates 60, 62 even at the bent portions 5*b* of the fins 5 joined to the end plates 60, 62. In FIGS. 9 and 10, reference numeral 71 denotes the side refrigerant passages defined inside the protruding portions 68, 69, 70 of the side plates 61, 62.

In the embodiments described above, the corrugated shape of the first fin 51 matches the corrugated shape of the second fin 52 on the same plane; however, the corrugated shapes of the first and second fins 51, 52 may be shifted from each other. The central drain groove 10 is provided generally at the central portion of the tube 2 in the air flow direction A; however, the drain groove 10 may be shifted to the upstream or the downstream side from the central portion of the tube 2. In this case, the gap portion 53 between the first and second fins 51, 52 should be shifted to face the shifted drain groove 10.

In the embodiments described above, each tube 2 is composed of two metallic thin plates 4 joined to each other. However, for example, the tube 2 can be formed from only one metallic thin plate by bending and joining both ends of the plate to thereby have the same cross-sectional shape shown in FIG. 2. A multi-hole flat tube formed by drawing may also be used as the tube 2 of the evaporator to which the present invention is applied.

Figure 12:
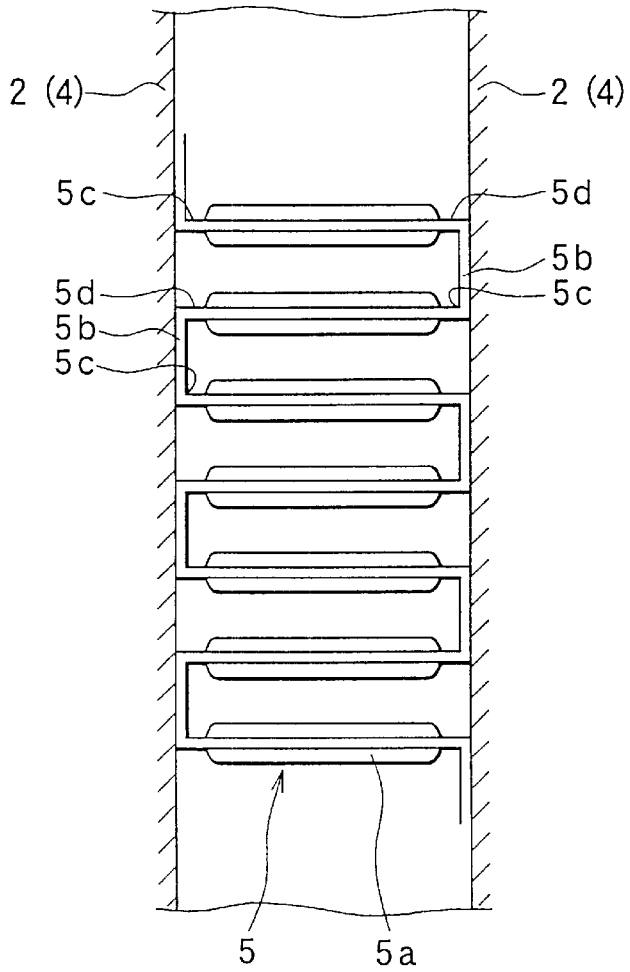
FIG. 12 PRIOR ART
FIG. 12 is an enlarged front view showing a corrugated fin of the evaporator in the prior art.

The bent portions 5*b* of the corrugated fin 5 (51, 52) is not limited to the arc-like shape as shown in FIG. 6B, but may be formed into a rectangular shape as shown in FIG. 12. The drain grooves 10, 11 need not always extend in the vertical direction, and may be inclined in a non-horizontal direction so that condensed water can flow in the grooves 10, 11 by a self-weight thereof.

While the present invention has been shown and described with reference to the foregoing preferred embodiments, it will be apparent to those skilled in the art that changes in form and detail may be made therein without departing from the scope of the invention as defined in the appended claims.

What is claimed is:

1. A refrigerant evaporator comprising:

a tube defining therein a flat passage extending in a vertical direction in which refrigerant flows and having an outer wall with a drain groove extending in the vertical direction for guiding condensed water downward; and a corrugated fin having a plurality of louvers for increasing a contact area with air flowing in an air flow direction, and joined to the outer wall of the tube, the corrugated fin including a first fin and a second fin, which are divided by a gap portion facing the drain groove of the tube, the first fin being disposed at an air upstream side of the second fin in the air flow direction wherein:

the first fin and the second fin are connected with each other via a connecting portion crossing the gap portion.

2. The refrigerant evaporator of claim 1, wherein a width of the gap portion of the corrugated fin in the air flow direction is smaller than that of the drain groove of the tube.

3. The refrigerant evaporator of claim 1, wherein an air downstream side end portion of the first fin and an air upstream side end portion of the second fin in the air flow direction face the drain groove.

4. The refrigerant evaporator of claim 1, wherein only the gap portion and an air downstream side end portion of the first fin in the air flow direction face the drain groove.

5. The refrigerant evaporator of claim 1, wherein only the gap portion and an air upstream side end portion of the second fin in the air flow direction face the drain groove.

6. The refrigerant evaporator of claim 1, wherein:

the corrugated fin is joined to the tube with a corrugated fin width in a width direction perpendicular to the outer wall of the tube; and the connecting portion has a width smaller than the corrugated fin width in the width direction.

7. The refrigerant evaporator of claim 1, wherein the tube has a first drain groove provided at a middle thereof in the air flow direction and facing the gap portion of the corrugated fin, and a second drain groove provided at a downstream side end portion thereof in the air flow direction.

8. The refrigerant evaporator of claim 1, further comprising:

a plurality of tubes and a plurality of corrugated fins which are laminated with one another in a lamination direction, the plurality of corrugated fins including a most outer side corrugated fin disposed at a most outer side in the lamination direction and divided into the first and second fins by the gap portion; and an end plate joined to the most outer side corrugated fin, and having an end plate drain groove extending in the vertical direction for guiding condensed water, the end plate drain groove facing the gap portion of the most outer side corrugated fin.

9. The refrigerant evaporator of claim 1, wherein the corrugated fin has flat bent portions extending approximately parallel to the outer wall of the tube.

10. The refrigerant evaporator of claim 9, wherein the plurality of louvers are provided in close proximity to the flat bent portions.

11. A refrigerant evaporator comprising:

a tube defining therein a passage in which refrigerant flows for exchanging heat with air flowing outside the tube in an air flow direction, and having an outer wall with a drain groove extending in a non-horizontal direction for guiding condensed water downward, the condensed water being produced by the air outside the tube; and a corrugated fin including a first fin and a second fin, which are joined to the outer wall of the tube and are divided by a gap portion extending approximately in parallel to the drain groove to face the drain groove in the non-horizontal direction wherein:

the first fin and the second fin are connected with each other by a connecting portion crossing the gap portion.

12. The refrigerant evaporator of claim 11, wherein:

the non-horizontal direction is approximately parallel to a vertical direction; and the air flow direction is approximately parallel to a horizontal direction.

13. The refrigerant evaporator of claim 11, wherein the first fin is disposed at an air upstream side of the second fin in the air flow direction.

14. The refrigerant evaporator of claim 11, wherein the gap portion extends in a direction approximately in a corrugated direction of the first and second fins such that all crest portions of the first and second fins face the gap portion.

15. The refrigerant evaporator of claim 11, wherein a width of the gap portion is smaller than that of the drain groove.

16. A refrigerant evaporator comprising:

a tube defining therein a flat passage extending in a vertical direction in which refrigerant flows and having an outer wall with a drain groove extending in the vertical direction for guiding condensed water downward; and a corrugated fin having a plurality of louvers for increasing a contact area with air flowing in an air flow direction, and joined to the outer wall of the tube, the corrugated fin including a first fin and a second fin, which are divided by a gap portion open to the drain groove of the tube, the first fin being disposed at an air upstream side of the second fin in the air flow direction wherein:

the first fin and the second fin are connected with each other via a connecting portion crossing the gap portion.

* * * * *